US005664331A

United States Patent [19]

Yu

[11] Patent Number: 5,664,331

[45] Date of Patent: Sep. 9, 1997

[54] CIGAR CUTTER HAVING A SAFE GUARD

[76] Inventor: Chin-Tung Yu, No. 2, Lane 320, Te Feng Road Section 1, Ta Li City, Taichung Hsien, Taiwan

[21] Appl. No.: 718,760

[22] Filed: Sep. 23, 1996

[51] Int. Cl.[6] ..... B26B 29/00

[52] U.S. Cl. ..... 30/113; 30/241

[58] Field of Search ..... 30/111–113, 241, 30/286; 7/118, 119

[56] References Cited

U.S. PATENT DOCUMENTS

| | | | |
|---|---|---|---|
| 175,898 | 4/1876 | Arentz | 7/118 |
| 487,562 | 12/1892 | Attacher | 7/118 X |
| 911,804 | 2/1909 | Barton | 30/113 |
| 1,007,390 | 7/1911 | Woods | 30/113 |
| 1,094,338 | 4/1914 | Leisegang | 30/112 X |

*Primary Examiner*—Douglas D. Watts

*Attorney, Agent, or Firm*—Charles E. Baxley, Esq.

[57] ABSTRACT

A cigar cutter includes a housing having an opening formed in the middle portion for engaging with a cigar. A cutter blade is slidably engaged in the housing and movable across the opening for cutting the cigar. A safe guard includes a pair of parallel panels for engaging onto the middle portion of the housing for shielding the cutter blade and for preventing the cutter blade from hurting a user. The housing includes one or more guiding grooves, and the safe guard includes one or more projections for engaging with the guiding groove and for guiding the relative movement between the safe guard and the housing. The guiding grooves each includes two ends having an orifice for engaging with the projection of the safe guard and for maintaining the safe guard in the open position and the enclosed position.

4 Claims, 3 Drawing Sheets

CIGAR CUTTER HAVING A SAFE GUARD

BACKGROUND OF THE INVENTION

1. Field of the Invention

The present invention relates to a cutter, and more particularly to a cutter for cutting cigar.

2. Description of the Prior Art

Typical cigars may not be used up all at once and should be distinguished one or more times for storing purposes. However, the distinguished end of the cigar may pollute the cloth or the cigar receiving box. Some of the cutters have been provided for cutting the cigar. However, the cutter blade is exposed and will hurt the fingers of the user inadvertently.

The present invention has arisen to mitigate and/or obviate the afore-described disadvantages of the conventional cigar cutters.

SUMMARY OF THE INVENTION

The primary objective of the present invention is to provide a cutter for cutting off the distinguished end of the cigar.

The other objective of the present invention is to provide a cigar cutter which includes a safe guard for shielding the cutter blade and for preventing the cutter blade from hurting the user.

In accordance with one aspect of the invention, there is provided a cigar cutter comprising a housing including a middle portion having an opening formed therein for engaging with a cigar, a cutter blade slidably engaged in the housing and movable across the opening for cutting the cigar, and a safe guard including a pair of parallel panels far engaging onto the middle portion of the housing, the safe guard being adapted to be moved between an open position and an enclosed position for shielding the cutter blade and for preventing the cutter blade from hurting a user.

The housing includes at least one guiding groove formed therein, the safe guard includes at least one projection formed thereon for engaging with the guiding groove and for guiding a relative movement between the safe guard and the housing.

The guiding groove includes two ends each having an orifice formed therein, the projection of the safe guard is engaged with the orifices for maintaining the safe guard in the open position and the enclosed position.

The housing includes a front portion and a rear portion each having a depression formed therein for receiving said panels of said safe guard.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
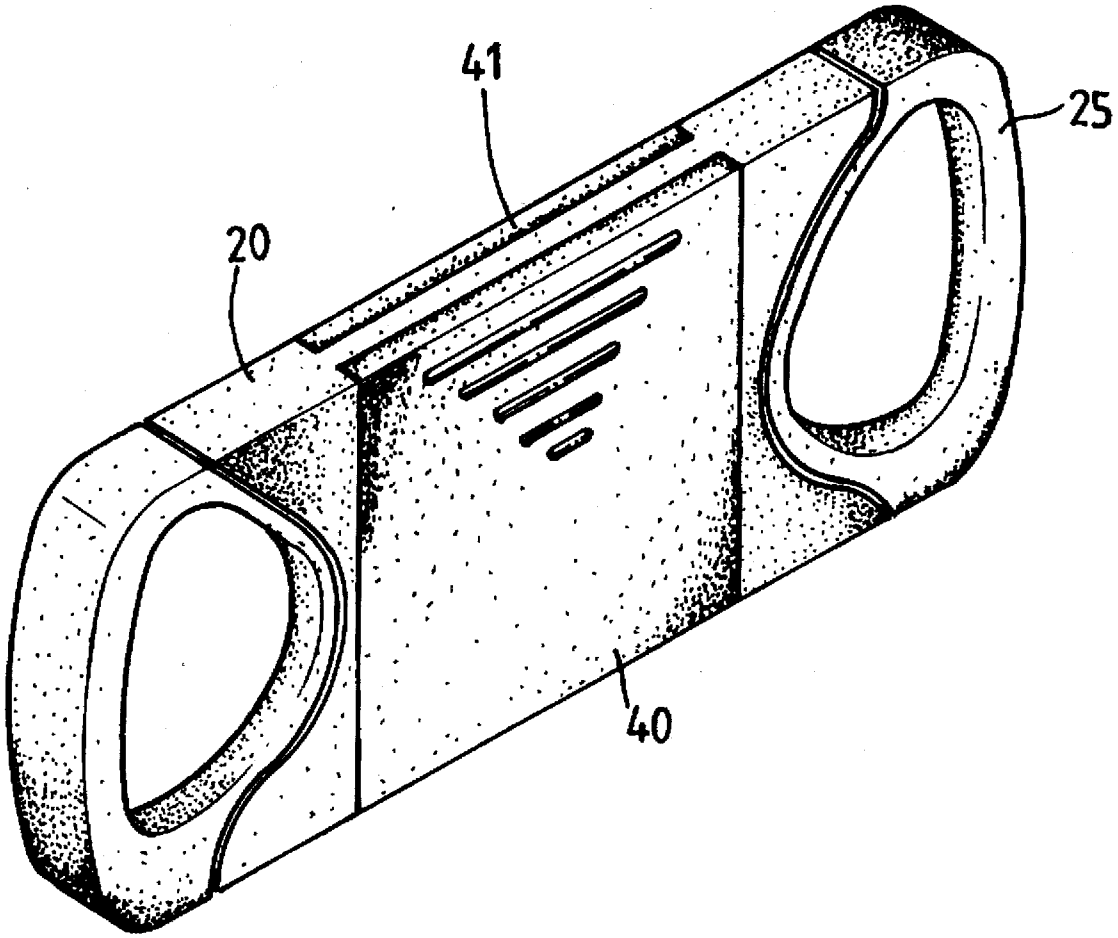
FIG. 1 is a perspective view of a cigar cutter in accordance with the present invention, in which the safe guard is closed.
Figure 2:
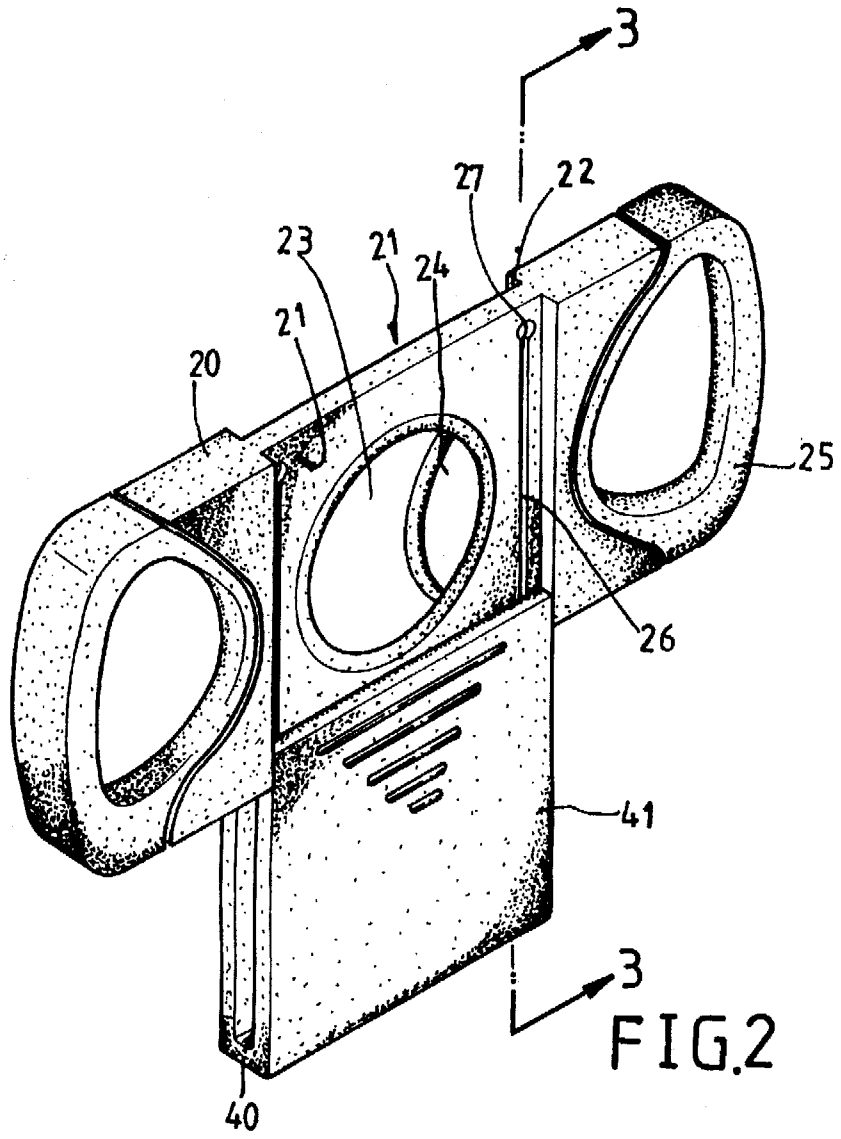
FIG. 2 is a perspective view of the cigar cutter, in which the safe guard is opened.
Figure 3:
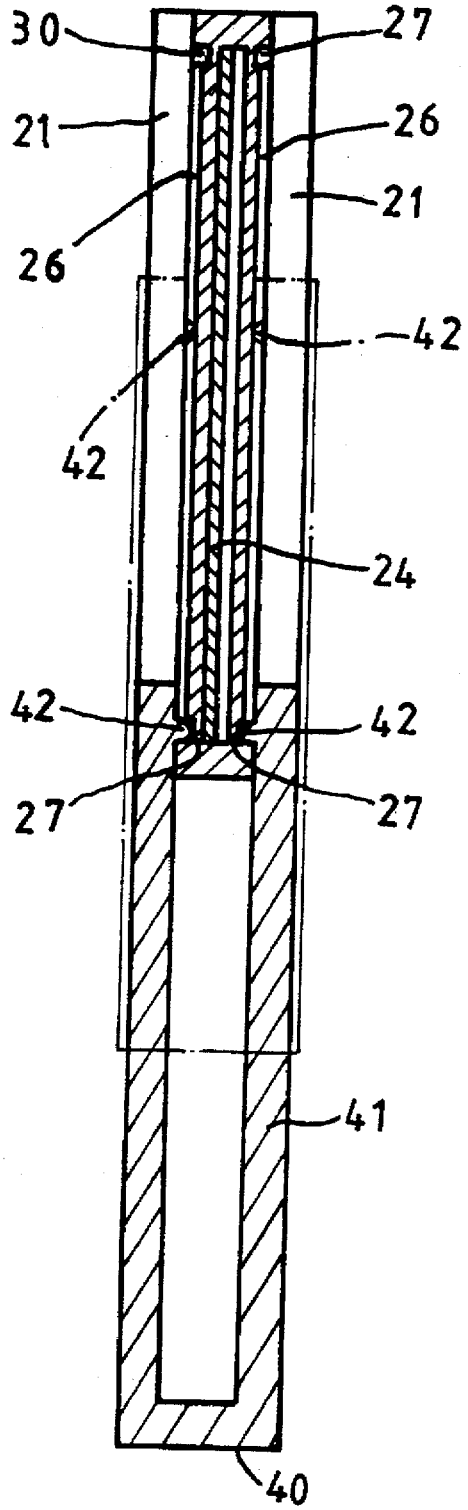
FIG. 3 is a cross sectional view taken along lines 3—3 of FIG. 2.

Referring to FIGS. 1–3, a cigar cutter in accordance with the present invention comprises a housing 20 including a pair of depressions 21 formed in the front and the rear portions thereof so as to define two pairs of side shoulders 22. An opening 23 is formed in the center portion of the housing 20 for engaging with a tip of a cigar therein. A pair of cutter blades 24 are slidably engaged in the housing 20 and movable across the opening 23 for cutting the cigar. A pair of handles 25 are secured to the cutter blades 24 for moving the cutter blade 24 across the opening 23 and for cutting the cigar. The housing 20 includes a pair of guiding grooves 26 each including two orifices 27 formed in the end portions. The orifices 27 includes a diameter slightly greater than the width of the grooves 26.

A safe guard 40 includes a pair of parallel panels 41 slidably engaged in the depressions 21 of the housing 20 for enclosing the opening 23 and for preventing the cutter blade 24 from hurting the fingers of the user. The panels 41 each includes two projections 42 (FIG. 3) for slidably engaging with the grooves 26 and for guiding the relative movement of the safe guard 40 relative to the housing 20. The projections 42 may engage with the upper orifices 27 for maintaining the safe guard 40 in the closed position as shown in FIG. 1, and may engage with the lower orifices 27 far maintaining the safe guard 40 in the open position as shown in FIG. 2. When the safe guard 40 is located in the closed position (FIG. 1), the cutter blade 24 may be shielded and may be prevented from hurting the fingers of the users.

Accordingly, the cigar cutter in accordance with the present invention includes at least one cutting blade for cutting the cigar and includes a safe guard for shielding the cutter blade and for preventing the cutter blade from hurting the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cigar cutter comprising:

a housing including a middle portion having an opening formed therein for engaging with a cigar, at least one cutter blade slidably engaged in said housing and movable across said opening for cutting the cigar, and a safe guard including a pair of parallel panels for engaging onto said middle portion of said housing, said safe guard being adapted to be moved between an open position and an enclosed position for shielding said cutter blade and for preventing said cutter blade from hurting a user.

2. A cigar cutter according to claim 1, wherein said housing includes at least one guiding groove formed therein, said safe guard includes at least one projection formed thereon for engaging with said guiding groove and for guiding a relative movement between said safe guard and said housing.

3. A cigar cutter according to claim 2, wherein said guiding groove includes two ends each having an orifice formed therein, said projection of said safe guard is engaged with said orifices for maintaining said safe guard in said open position and said enclosed position.

4. A cigar cutter according to claim 1, wherein said housing includes a front portion and a rear portion each having a depression formed therein for receiving said panels of said safe guard.

* * * * *